United States Patent [19]

Deters

[11] Patent Number: 4,516,817

[45] Date of Patent: May 14, 1985

[54] ELECTRICAL JUMPER ASSEMBLY

[76] Inventor: Paul M. Deters, 2105 Harkness St., Manhattan Beach, Calif. 90266

[21] Appl. No.: 488,165

[22] Filed: Apr. 25, 1983

[51] Int. Cl.[3] ..... H01R 31/08

[52] U.S. Cl. ..... 339/19; 339/95 D; 339/222

[58] Field of Search ..... 339/19, 95 D, 222

[56] References Cited

U.S. PATENT DOCUMENTS

| | | | |
|---|---|---|---|
| 2,700,752 | 1/1955 | Cataldo | 339/164 |
| 3,493,915 | 2/1970 | Cox | 339/19 |
| 3,555,497 | 1/1971 | Watanabe | 339/258 |
| 3,582,864 | 6/1971 | Sullivan | 339/19 |
| 3,685,001 | 8/1972 | Krafthefer | 339/17 L |
| 3,951,497 | 4/1976 | Balzano et al. | 339/19 |
| 4,283,100 | 8/1981 | Griffin et al. | 339/19 |

FOREIGN PATENT DOCUMENTS

| | | | |
|---|---|---|---|
| 2544065 | 4/1976 | Fed. Rep. of Germany | 339/19 |

*Primary Examiner*—Gil Weidenfeld
*Assistant Examiner*—Paula Austin
*Attorney, Agent, or Firm*—Jack C. Munro

[57] ABSTRACT

An electrical jumper assembly for establishing an electrical connection between a spaced pair of terminal posts. The electrical jumper assembly is formed of a sheet material, non-electrically conductive housing within which there is located an electrical conducting bar. Attached to said bar are a pair of spaced-apart, spring biased clips. The terminal posts are to penetrate the housing and tightly engage with the spring biased clips forming an electrical connection through the bar. The plug closes the open, upper end of the housing. Each longitudinal end of the plug includes a recess. A terminal post is to connect with each recess.

11 Claims, 9 Drawing Figures

ELECTRICAL JUMPER ASSEMBLY

BACKGROUND OF THE INVENTION

The field of this invention relates to an electrical connector in the form of an electrical jumper assembly for establishing an electrical conductive path between a pair of spaced elongated electrical conducting members.

A simplified definition of a bus, in regard to electronics, is a conductor or group of conductors which serves as a common connection for two or more circuits. Frequently, buses are usually constructed to be in the form of a bar, hence the term "bus bar".

Buses can be of any given size. Usually one side of a bus bar includes some type of an electrical circuitry, such as a printed circuit board. Protruding from the opposite side of the printed circuit board are a plurality of spaced-apart male electrical conductors in prong form which are frequently referred to as terminal posts.

A single bus bar can utilize a few terminal posts, or a substantial number of terminal posts. In most instances, the spacing between directly adjacent terminal posts is identical.

It is frequently desirable to establish an electrical connection between one terminal post and another. In the past, such electrical connections have taken numerous forms, such as, for example, a bare wire being wrapped onto each terminal post and extending therebetween. Also, numerous type of clips have been previously used.

In recent years, printed circuit boards and bus bars have become smaller in size, and because of this small size, it is necessary to utilize a small sized clip. Such a clip must be constructed in a manner to avoid electrical shorts and yet must provide a positive path for the electrical energy which is conducted through the clip.

Additionally, because a substantial number of such electrical connectors within any given installation may be utilized, and there being a widespread usage requirement for such clips, it is desirable that these electrical connectors be constructed in a manner to minimize cost of manufacture. Literally millions of such clips may be used in any given year. A savings on the manufacturing cost of a mere tenth of a cent per clip amounts to a substantial amount of money in any given year.

SUMMARY OF THE INVENTION

An electrical jumper assembly for establishing an electrical connection between a pair of spaced-apart terminal posts which includes a pair of U-shaped clips which are integrally attached to an electrically conductive bar. The clips are spaced from each other. This spacing can be varied so as to construct electrical jumpers of different sizes. Each clip has an apex and within each apex is located an access opening. The clips and the attached bar are located in a close fitting manner within an internal chamber of a non-electrically conductive housing. The access openings of each clip assembly are located directly adjacent the bottom wall of the housing. Formed through the bottom wall of the housing are a pair of spaced-apart openings. A separate terminal post is to extend through each opening of the housing and also through an access opening in the clip and then be biased into tight engagement by the clip to achieve positive electrical connection. The top wall of the housing forms an enlarged opening to permit entry of the clip assembly and connected bar within the internal chamber of the housing. This enlarged opening is normally closed by a plug which is mounted in a close fitting manner within this enlarged opening. The plug is normally secured as by adhesive to the housing. The plug has a centrally located extending section which forms an inner recess at each longitudinal end of the plug. A terminal post is to be locatable within a recess. The plug is not electrically conductive. The central section of the plug may extend a sufficient distance to be located between the spaced-apart clips. The central section of the plug may include a longitudinal groove. The bar which connects the clips is to nest within that groove.

DETAILED DESCRIPTION OF THE SHOWN EMBODIMENT

Figure 1:
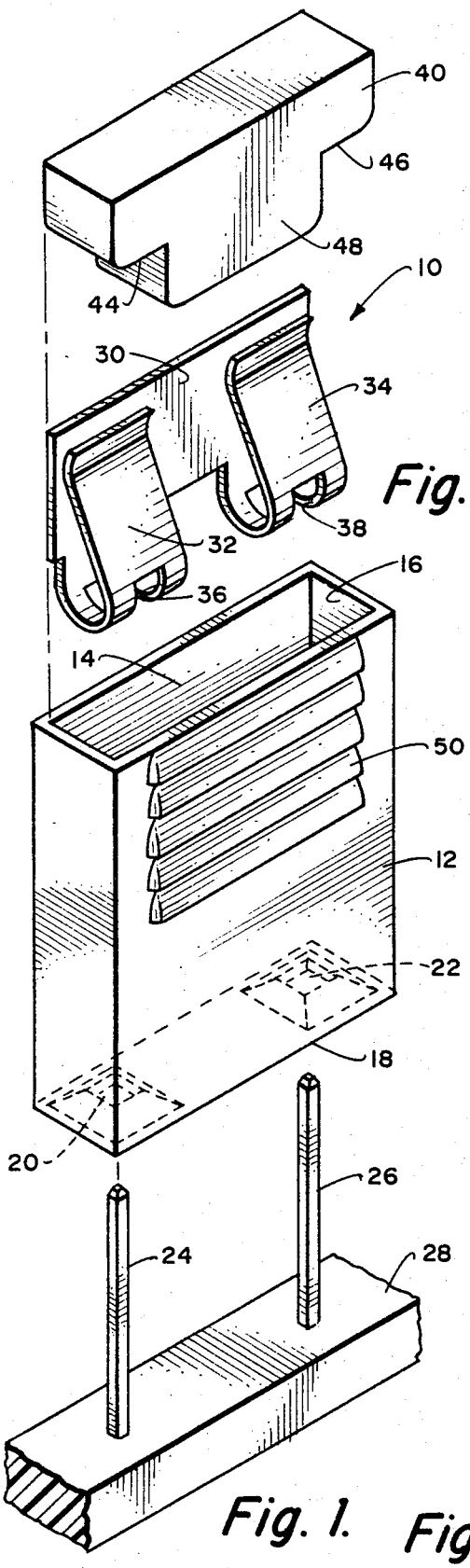
FIG. 1 is an exploded, isometric view of the electrical jumper assembly of this invention depicting the connection of such to a pair of spaced-apart terminal posts of a bus bar.
Figure 2:
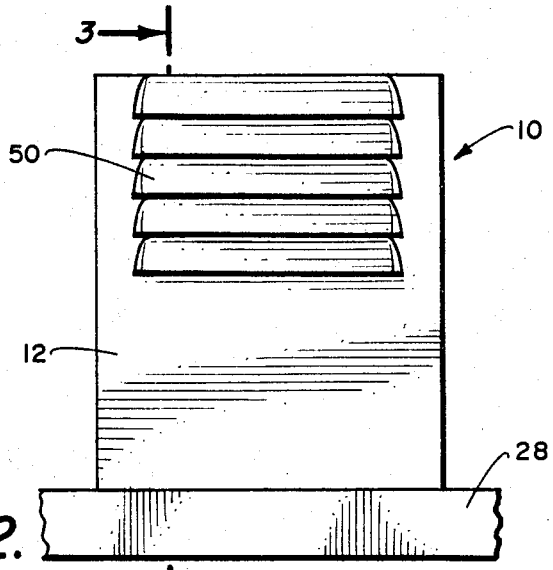
FIG. 2 is a side, elevational view of the electrical jumper assembly of this invention showing such installed upon the terminal posts of the bus bar.
Figure 3:
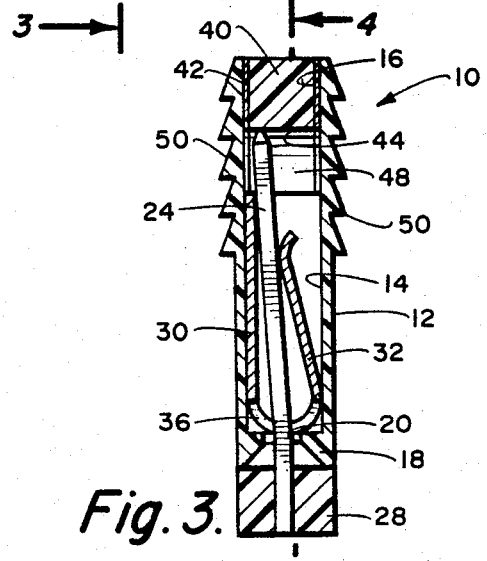
FIG. 3 is a cross-sectional view taken along line 3—3 of FIG. 2.
Figure 4:
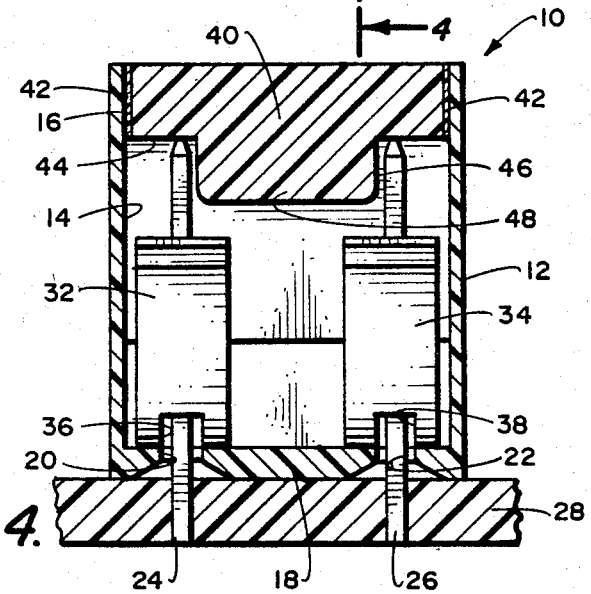
FIG. 4 is a cross-sectional view taken along line 4—4 of FIG. 3.
Figure 5:
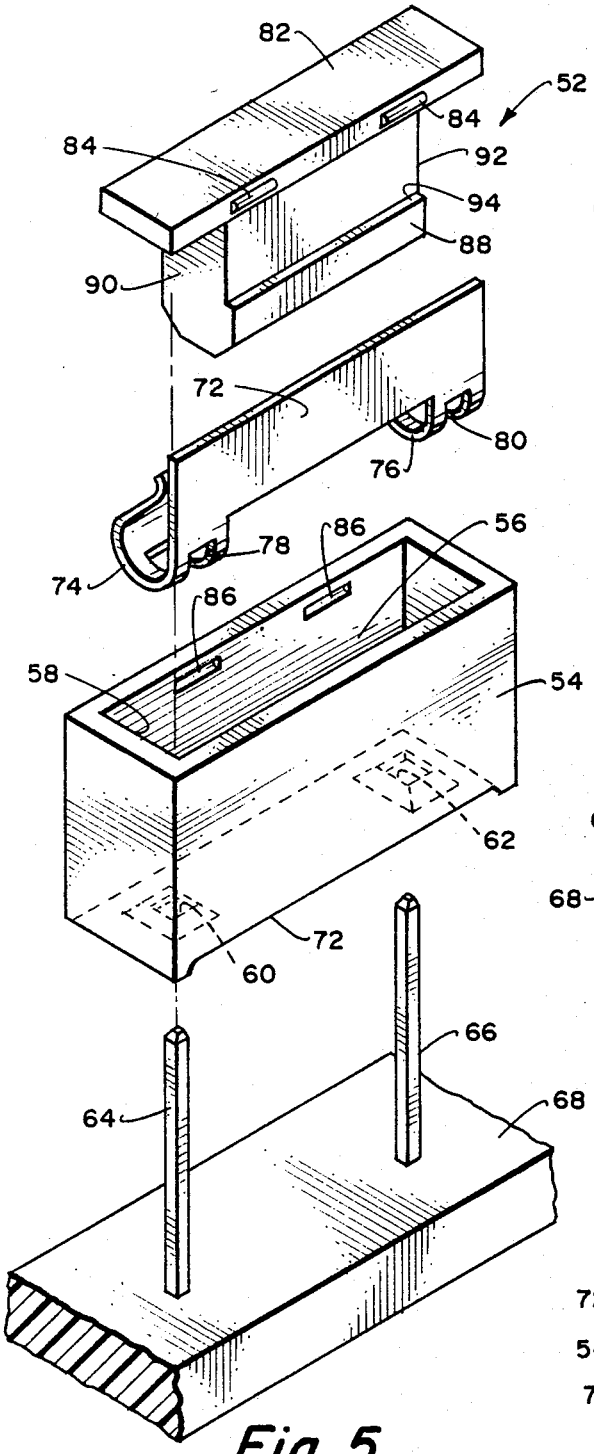
FIG. 5 is an exploded, isometric view similar to FIG. 1 but of a modified form of an electrical jumper assembly of this invention.
Figure 6:
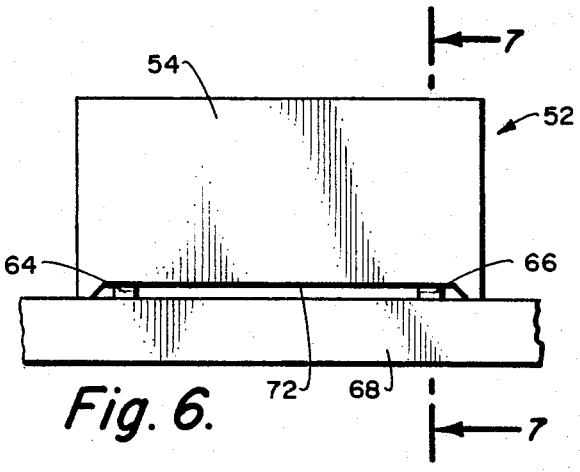
FIG. 6 is a side, elevational view similar to FIG. 2 but of the modified form of electrical jumper assembly of this invention.
Figure 7:
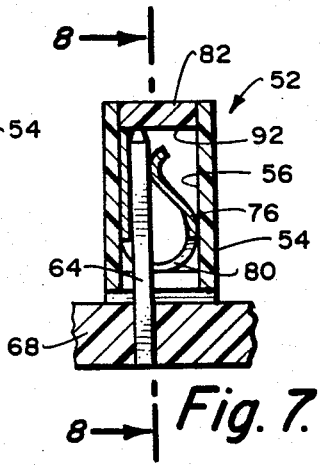
FIG. 7 is a cross-sectional view taken along line 7—7 of FIG. 6.
Figure 9:
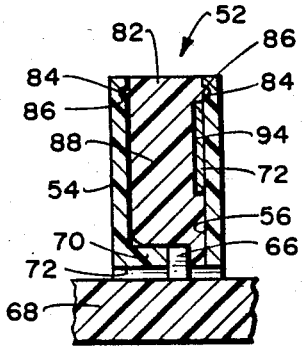
FIG. 9 is a cross-sectional view taken along line 9—9 of FIG. 8.
Figure 8:
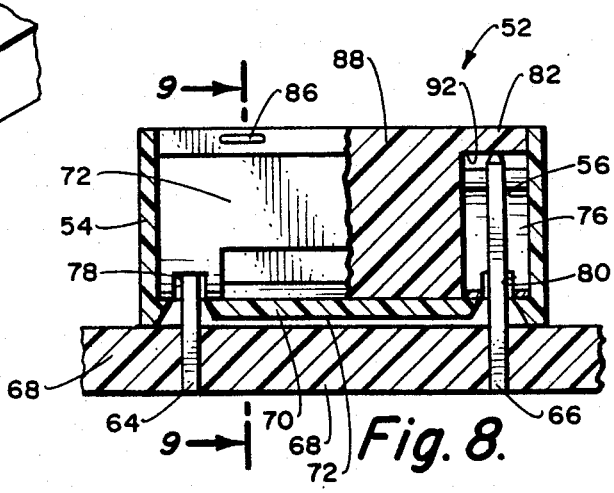
FIG. 8 is a cross-sectional view taken along line 8—8 of FIG. 7.

Referring particularly to FIGS. 1–4 of the drawings, there is shown the electrical jumper assembly 10 of this invention. The jumper assembly 10 includes a non-electrically conductive housing 12. The housing 12 is to be constructed of a sheet material plastic. The housing 12 includes an internal chamber 14. The top wall of the housing 12 includes an enlarged opening 16 which has a cross-sectional area equal to the cross-sectional area of the internal chamber 14. The bottom wall 18 of the housing 12 includes a pair of spaced-apart entry openings 20 and 22. The surface of the bottom wall 18 located directly around each of the openings 20 and 22 is flared so as to facilitate conducting respectively of the terminal posts 24 and 26 therethrough.

Each of the terminal posts 24 and 26 are basically square in cross-section. The terminal posts 24 and 26 are elongated resembling a prong. The posts 24 and 26 are mounted onto a bus bar base 28. The showing of the terminal posts 24 and 26 and the bus bar 28 are merely for illustrative purposes. In actual practice, there will normally be utilized a mass of posts 24 and 26 which are mounted in conjunction with a bus bar base 28. However, for illustrative purposes, only two in number of the posts 24 and 26 have been shown.

To be located within the internal chamber 14 in a close fitting manner, is a bar 30 which has integrally attached thereto U-shaped clips 32 and 34. The clips 32 and 34 are spaced-apart but are connected by the bar 30. It is to be understood that different jumper assemblies 10 can be constructed where the spacing between the clips 32 and 34 is different. The size of the housing 12, as well as the spacing between the entry openings 20 and 22 is selected according to the particular size of jumper assembly.

Formed within the apex of the clips 32 and 34, respectively, are access openings 36 and 38. The terminal post 24 is to pass through the access opening 36 and slightly force the unattached leg of the clip 32 outward from the bar 30. This creates a slight biasing force which pinches onto the terminal post 24. In a similar manner, a pinching occurs of the terminal post 26 by the clip 34. This pinching of the force assures a positive, continuous electrical connection between the posts 24 and 26 and the bar 30.

The enlarged opening 16 is to be normally closed by means of a plug 40. The plug 40 is to be secured in place within enlarged opening 16 by means of an adhesive 42. The inner surface of the plug 40 is formed to include recesses 44 and 46. The recess 44 is formed within one end of the plug 40, with the other recess 46 formed within the opposite end of the plug 40. The terminal post 24 is to be located within the recess 44, with the terminal post 26 to be located within the recess 46. As a result, there is a central extending portion 48 of the plug 40 which is located between the terminal posts 24 and 26. The portion 48 insures that the posts 24 and 26 are located parallel and prevents such from assuming a bent configuration.

In most instances, the physical size of the housing 12 will be quite small, such as no more than three-eights of an inch square. These electrical jumper assemblies are to be manually installed at the desired location. To facilitate this manual grasping of each of the jumper assemblies 10, the exterior portion of the housing 12 includes a series of ridges 50. The ridges 50 are to function to prevent the jumper assembly 10 from slipping out of one's hand.

Referring particularly to FIGS. 5–9, there is shown a modified form of electrical jumper assembly 52. The jumper assembly 52 is constructed in substantially the same manner of a housing 54, which has an internal chamber 56. Access into the internal chamber is formed through the top wall through an enlarged opening 58. Entry openings 60 and 62 are formed through the bottom wall 70 of the housing 54.

The surface around each of the entry openings 60 and 62 is flared to facilitate respective connection to the terminal posts 64 and 66 of a bus bar base 68. It is to be noted that the bottom wall 10 is recessed slightly with respect to its outer ends forming recessed area 72. As a result, the recessed area 72 assumes a slight spacing from the bus bar base 68.

To be located within the internal chamber 56 is a bar 72 to which is integrally attached at each end thereof, clips 74 and 76. The clips 74 and 76 are basically identical to clips 32 and 34, as is also bar 72 similar to bar 30. One distinction between the structure of FIG. 5 versus that of FIG. 1 is that the spacing between the clips 74 and 76 is greater than the spacing between the clips 32 and 34.

Within the clip 74 is located an access opening 78. Within the clip 76 is located an access opening 80. The terminal post 64 is to be conducted through the access opening 78, with the terminal post 66 being conducted through the access opening 80.

The enlarged opening 58 is normally closed by means of a plug 82. The fore and aft edges of the plug 82 include protuberances 84. The protuberances 84 are to connect with grooves 86 formed within the wall of the opening 58. The connection of the grooves 86, with the protuberances 84 are to securely hold in place the plug 82 within the enlarged opening 58.

The plug 82 includes an enlarged center extending portion 88. The fore end of the portion 88 has been removed forming a recess 90, with the aft end of the portion 88 having been removed forming a recess 92. The clip 74 is to be located within the recess 90, with the clip 76 to be located within the recess 92. The lower edge of the portion 88 comes into contact with the inner surface of the bottom wall 70.

With the lower surface of the portion 88 contacting the bottom wall 70, the bar 72 nests within longitudinal groove 94 formed within the portion 88. As a result, the bar 72 is securely held in its established position by the groove 94. Also by the interlocking of the protuberances 84 and the grooves 86, the plug 82 is securely fixed in position relative to the housing 54.

What is claimed is:

1. An electrical jumper assembly for establishing an electrical connection between a pair of spaced-apart terminal posts comprising:

a housing, said housing having an internal chamber enclosed by a side wall assembly, said side wall assembly terminating in a top wall and a bottom wall, a first opening arrangement formed within said top wall, a second opening arrangement formed within said bottom wall, an electrical conducting bar, said bar having a spring biased clip assembly, said clip assembly forming two in number of clips located in a spaced-apart manner, said bar being totally located within said internal chamber in a closefitting manner, each said clip assembly to engage with a said terminal post and be spring biased in a continuous contact therewith;

retaining means connected with said housing for holding said bar in position within said internal chamber;

said internal chamber having a wall surface, said first opening arrangement having a periphery in alignment with said wall surface;

said second opening arrangement comprising two separate spaced-apart openings, a said terminal post being adapted to be conducted through each said separate spaced-apart openings;

each said clip being basically U-shaped in configuration and defining a pair of spaced-apart leg members, one of said leg members being integrally attached to said bar, the other of said leg members having an outer free end, each said clip having a apex interconnecting said leg members, each said apex to be located directly adjacent said second opening arrangement;

each said apex including an access opening, a said terminal post to extend through said access opening to be biasingly held between said legs of said clip; and a plug located in a closefitting manner within said first opening arrangement, said plug having recesses formed at each longitudinal end thereof, a said terminal post to be locatable within a said recess.

2. The electrical jumper assembly as defined in claim 1 wherein:

said retaining means further includes an adhesive, said adhesive being located between the exterior surface of said plug and the wall of said internal chamber.

3. The electrical jumper assembly as defined in claim 1 wherein:

a portion of said plug is to be positioned between said clips.

4. The electrical jumper asembly as defined in claim 3 wherein:

said portion of said plug including a longitudinal groove, the section of said bar located between said clips to be located within said longitudinal groove.

5. The electrical jumper assembly as defined in claim 4 wherein said retaining means further comprises:

an interlocking protuberance and groove assembly connected between said plug and said housing.

6. An electrical jumper assembly for establishing an electrical connection between a pair of spaced-apart terminal posts comprising:

a housing, said housing having an internal chamber enclosed by a side wall assembly, said side wall assembly terminating in a top wall and a bottom wall, a first opening arrangement formed within said top wall, a second opening arrangement formed within said bottom wall, an electrical conducting bar, said bar having a spring biased clip assembly, said clip assembly forming two in number of clips located in a spaced-apart manner, said bar being totally located within said internal chamber in a closefitting manner, each said clip assembly to engage with a said terminal post and be spring biased in a continuous contact therewith; and retaining means connected with said housing for holding said bar in position within said internal chamber, said retaining means comprising a plug located in a closefitting manner within said first opening arrangement, said plug having recesses formed at each longitudinal end thereof, a said terminal post to be locatable within a said recess.

7. The electrical jumper assembly as defined in claim 6 wherein:

said retaining means further includes an adhesive, said adhesive being located between the exterior surface of said plug and the wall of said internal chamber.

8. The electrical jumper assembly as defined in claim 6 including:

finger grasp areas formed on the exterior surface of said housing, said finger grasp area to facilitate manual grasping and holding of said jumper assembly to facilitate connection with and removal from said terminal posts.

9. The electrical jumper assembly as defined in claim 6 wherein:

a portion of said plug is to be positioned between said clips.

10. The electrical jumper assembly as defined in claim 9 wherein:

said portion of said plug including a longitudinal groove, the section of said bar located between said clips to be located within said longitudinal groove.

11. The electrical jumper assembly as defined in claim 10 wherein said retaining means further comprises:

an interlocking protuberance and groove assembly connected between said plug and said housing.

* * * * *